US009242134B2

(12) United States Patent
Miltner et al.

(10) Patent No.: US 9,242,134 B2
(45) Date of Patent: Jan. 26, 2016

(54) SPRING LOADED WEIGHT STACK SELECTOR PIN

(71) Applicants: Heinz Richard Miltner, Rosamond, CA (US); Julie Lynn Adams, Rosamond, CA (US)

(72) Inventors: Heinz Richard Miltner, Rosamond, CA (US); Julie Lynn Adams, Rosamond, CA (US)

( * ) Notice: Subject to any disclaimer, the term of this patent is extended or adjusted under 35 U.S.C. 154(b) by 232 days.

(21) Appl. No.: 14/084,366

(22) Filed: Nov. 19, 2013

(65) Prior Publication Data

US 2014/0274591 A1 Sep. 18, 2014

Related U.S. Application Data

(60) Provisional application No. 61/852,138, filed on Mar. 15, 2013.

(51) Int. Cl.
*A63B 21/062* (2006.01)
*A63B 21/00* (2006.01)

(52) U.S. Cl.
CPC ..... *A63B 21/062* (2013.01); *A63B 21/00069* (2013.01); *A63B 2021/0623* (2013.01)

(58) Field of Classification Search
CPC ..... A63B 21/062; A63B 2021/0623; A63B 2021/0626; A63B 21/068; A63B 21/00061; A63B 21/00065; A63B 21/0069; A63B 21/00076
USPC ..... 403/324, 328, 378, 379.5
See application file for complete search history.

(56) References Cited

U.S. PATENT DOCUMENTS

| | | | | | |
|---|---|---|---|---|---|
| 4,546,971 | A * | 10/1985 | Raasoch | A63B 21/062 | 482/100 |
| 4,610,449 | A * | 9/1986 | Diercks, Jr. | A63B 21/062 | 482/98 |
| 5,306,221 | A * | 4/1994 | Itaru | A63B 21/062 | 482/97 |
| 5,350,344 | A * | 9/1994 | Kissel | A63B 21/062 | 482/98 |
| 5,556,362 | A * | 9/1996 | Whipps | A63B 21/062 | 482/97 |
| 7,011,609 | B1 * | 3/2006 | Kuo | A63B 21/062 | 482/94 |
| 7,316,638 | B1 * | 1/2008 | Fabela | A63B 21/062 | 482/93 |
| 7,473,211 | B2 * | 1/2009 | Lee | A63B 21/062 | 482/94 |
| 8,454,260 | B2 | 6/2013 | Wilcoxson | | |
| 2011/0091272 | A1 * | 4/2011 | Wilcoxson | A63B 21/062 | 403/325 |
| 2014/0274591 | A1 * | 9/2014 | Miltner | A63B 21/062 | 482/98 |
| 2015/0224357 | A1 * | 8/2015 | Lojek | A63B 21/062 | 482/98 |

* cited by examiner

*Primary Examiner* — Matthew F Desanto

(57) ABSTRACT

A portable spring loaded selector pin device comprising of an automatic release mechanism for use in performing intense weight lifting exercises involving reduced weight lifting sequences on weight lifting machines having weight stacks comprising of a plurality of weight plates. One or more spring loaded selector pin devices may be deployed, allowing the selection of multiple weight reductions to be preset. The spring loaded selector pin device utilizes the friction created by the weight plates to remain engaged while the weight is lifted, and automatically releases immediately after the weight is set down, making the next preset weight ready to be lifted without any interruption in the exercise.

10 Claims, 3 Drawing Sheets

SPRING LOADED WEIGHT STACK SELECTOR PIN

CROSS-REFERENCE TO RELATED PATENT APPLICATIONS

This application claims priority from U.S. Provisional Application No. 61/852,138, filed Mar. 15, 2013, incorporated herein by reference in its entirety.

BACKGROUND

1. Field of the Invention

Embodiments of the present invention generally relate to selector pins, and, in specific embodiments, to spring loaded selector pins for weight stacks.

2. Related Art

Weight training consists of strength training exercises that utilize weights to increase physical strength and develop the size of skeletal muscles, as well as to increase metabolism in order to reduce weight, and improve overall fitness. A variety of equipment is used in weight training to target specific muscle groups. This equipment can be in the form of free-weights utilizing weighted bars with independent weight plates, which may be added or removed, and dumbbells; or weight training machines with weight stacks containing a plurality of weights that are mechanically connected to the machine and utilize a selector device, typically an independent pin, to adjust the amount of weight to be lifted. Weight training machines are highly popular and used at gyms worldwide. Many sports use weight training as part of their training regimen such as football, basketball, track and field, hockey, and rowing. Most notably, bodybuilding and powerlifting use weight lifting as their principal training program.

Among the various weight training techniques are exercises that consist of intensive repetitions (reps), or reduced weight sets, commonly called Drop sets, which are used to push the trainee to a higher level of strength and fitness by reaching the point of muscle failure, making it impossible for the trainee to continue to move the weight.

Typically, when doing drop sets, a training partner supports the trainee, so the trainee is able to continue to make a few more additional reps with less weight in order to push their endurance and strength limit. Normally, after performing the last rep that the trainee can do on their own in a set without a training partner, the trainee would be required to put the weight down, but with the help of a training partner supporting their lift, they are able to continue to make two to three more extremely intensive reps. This will bring the trainee deep into their goal training zone. Being in the zone and the purpose of this intense weight training is to build maximum strength and muscle mass, and burn more calories faster.

Additionally, trainees can use weight training machines with weight stacks to perform reduced weight lifting sets, also known as Drop sets. When the trainee places the weight down after the last rep, they should preferably have a partner to quickly pull out or release the weight stack selector pin and re-insert it in a plate level with less weight. Usually, this process is repeated one to two times. This is a high intensity lifting exercise, because during this set the trainee is not only coming once to the point of muscle failure, but two, three, or more times.

There are significant disadvantages inherent in the current techniques for performing drop sets. If the trainee performs the reduced weight exercise using free-weights, a training partner is absolutely necessary, as it would be impossible to do so otherwise. Often trainees do not have a qualified training partner available and must use the fee-based services of a personal trainer, instead. Alternatively, if the trainee uses a weight training machine with a weight stack, the trainee needs either a training partner to re-set the weight amount, or the trainee must re-set the weight him or herself. This will result in the trainee loosing intensity in the exercise and muscle contraction in the time between resetting the weight. Despite having a training partner to change the weight, remove selector pins, or remove and re-insert selector pins in a weight stack, there is still a delay no matter how fast the training partner can perform the task, thus preventing the trainee from achieving their ultimate level of performance.

Conventional prior art in the field includes weight stack selector pins offered in a variety of designs and sizes configured and limited to the function of selecting and locking a specific amount of weight to be lifted. Examples of these basic weight stack selector pins are composed of simple rod-shaped shafts having a knob mounted at one end to use as a handle. These pins will remain in place at the preset weight until removed manually and re-installed in a different weight plate. More complex prior art uses springs to facilitate locking the weight selection, including externally actuated selector pins that are part of a weight stack machine spring loaded internal locking device mounted on each weight plate, in which the spring loaded action is specifically designed for engaging and locking the selected weight to be lifted, but again, must be manually released in order to change the weight.

Another prior art example is based on a timer apparatus that reduces the weight after a predetermined period of time. There are significant drawbacks to this system making it impractical. First, it is a complicated device to produce that can reduce the weight only once. Second, the device is cumbersome, limiting portability. Third, the expense for such a complex device would likely make it cost prohibitive for individual consumers, limiting its use to weight training machines that are pre-equipped with the device. Fourth, the device can potentially be more prone to system failure due to mechanical fatigue and wear, resulting in added maintenance and replacement costs.

In order to overcome the disadvantages associated with current training methods and the limitations associated with prior art weight selector devices and weight training machines, there is a need to provide a portable device system that automatically reduces the amount of weight selected in the weight stack, while allowing the trainee to safely continue with the Drop set exercise un-interrupted, maximizing the exercise intensity without the need for assistance of a training partner or personal trainer.

SUMMARY OF THE DISCLOSURE

Accordingly, the present invention provides a portable spring loaded weight stack selector pin system with an automatic release mechanism that out-performs any prior art device or method for weight lifting exercises involving reduce weight lift sequences using weight stack machines, delivering a superior exercise experience and maximizing results for the trainee, in a convenient and economical solution.

The spring loaded weight stack selector pin of the present invention is portable, can be carried easily in one hand, and convenient for the trainee to use at the gym. The present invention allows the trainee to preset multiple weight reductions by deploying additional spring loaded weight selector pins, including the standard selector pin that is normally provided with the weight training machine. Notably, the present invention may be used to selectively engage the last weight plate of a weight stack, lifting all the weight plates at once, in order to start a reduce weight lifting sequence with the heaviest weight possible. In addition, the spring loaded weight stack selector pin is adjustable, without the need for any special skills or tools, making it compatible with weight stack plates of differing dimensions and selector holes of different lengths, and as a result, may be used on a wide variety of weight training machines. Further, the spring loaded weight stack selector pin does not interfere with the operation of the weight training machine. Although there are prior art machines that incorporate integral weight selection devices, there are still a significant number of popular machines for every muscle group target area for which the present invention is compatible, providing the trainee with diverse exercise opportunities at their local gym.

The spring loaded weight stack selector pin of the present invention reduces the weight faster than any training partner can perform the same task. The spring loaded weight stack selector pin releases within a split second after the weight is set down, making the weight stack ready for the next preset weight to be lifted, thus allowing the trainee to complete their exercise faster, and achieve their ultimate level of performance by consistently maintaining muscle tension and generating an exercise intensity level not possible when using any other prior art technique or device. The time-saving advantage of the present invention is also a benefit to gyms, because it makes the weight training machine available for more members to access and use.

Upon reading and understanding the following detailed description and the accompanying drawings, other desirable features will be obvious to those of ordinary skill in the art.

BRIEF DESCRIPTION OF THE DRAWINGS

These and other features of the present invention are more fully set forth in the following description of exemplary embodiments of the invention. The description is presented with reference to the accompanying drawings in which.

DETAILED DESCRIPTION

The present invention may be implemented in the exemplary embodiments described herein. As will be understood by someone with ordinary skill in the art, other embodiments and alternative variations are possible without departing from the spirit of the present invention. Likewise, the components of the present invention may be produced using different manufacturing processes, such as molded, machined, or formed.

Additionally, the handle, pin shafts, and compression base with handle is illustrative and can be formed in different shapes such as more smooth and rounded, or squared-off, or ergonomically shaped to fit the inside curvature of the palm of the hand, fingers and thumb, for example. Further, the components of the present invention can have different surface finishes and textures to increase friction, improve grip, or for decorative purposes. As will be understood by someone with ordinary skill in the art, other embodiments utilizing different colors, shapes, curvature, or decorative designs may also be employed.

The spring loaded weight stack selector pin described herein may be made using different types of materials or combination of materials, including for example different metals and alloys, plastic, rubber, carbon fiber composites, or glass infused plastic. Rubber or other materials that increase friction may also be used for specific parts of the invention, such as the handle and other gripping areas. As will be understood by someone with ordinary skill in the art, a variety of materials may be used to manufacture the present invention without departing from the spirit of the invention.

The depiction of an exemplary weight training machine weight stack consisting of a plurality of weight plates is illustrative, and the present invention may be used with weight plates of different sizes, shapes, dimensions, and which incorporate weight stack selector pin holes in different sizes, shapes and length. Further, the depiction of an exemplary standard weight stack selector pin that is normally provided with a weight machine is illustrative and the present invention may be used whether or not a standard weight stack selector pin is provided.

Figure 1:
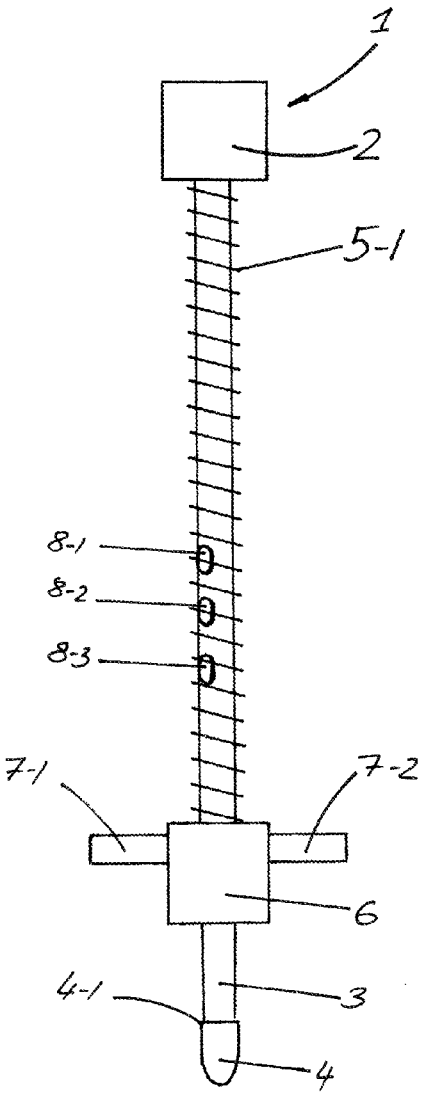
FIG. 1 is a side, elevated view of an exemplary spring loaded weight stack selector pin depicted in the released position according to an embodiment of the present invention.
Figure 2:
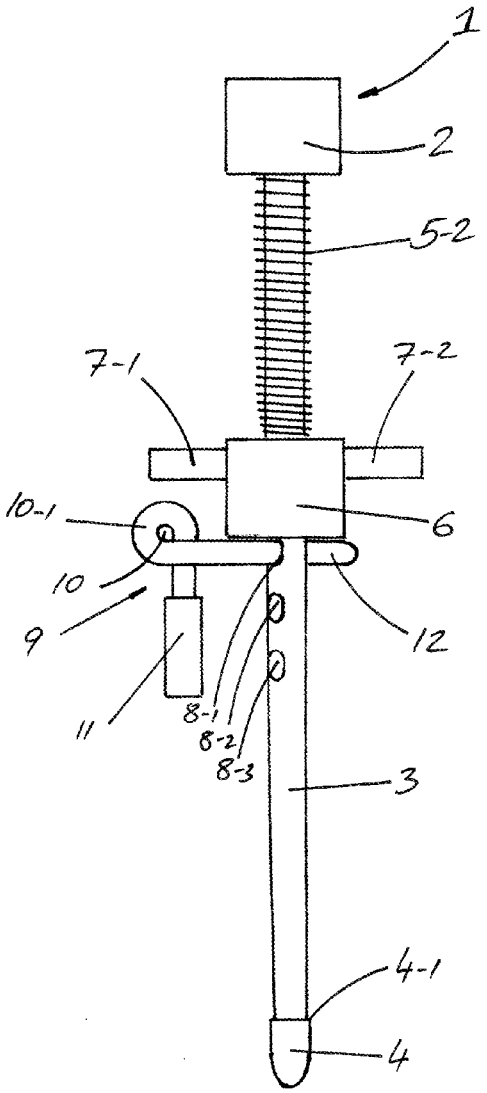
FIG. 2 is a side, elevated view of an exemplary spring loaded weight stack selector pin depicted in the compressed position with an exemplary removable safety pin inserted through one of the exemplary adjustment holes according to an embodiment of the present invention.

Further, as will be understood by someone with ordinary skill in the art, during a single set, one, two, or more spring loaded weight stack selector pins may be preset in advance and used successively on a weight training machine weight stack with or without the standard weight stack pin that normally is on the machine, during multiple reduced weight reps, or Drop set exercise, to accommodate the trainee's desired lifting sequence within the same set FIGS. 1-2 illustrate a spring loaded weight stack selector pin according to an embodiment of the present invention. In particular, FIG. 1 is a side elevated view of spring loaded weight stack selector pin 1 depicted in the released position with a handle 2 connected to the top of the pin shaft 3, which is inserted through spring 5-1 shown in the released position, and then through an moveable compression base 6 which has a handle grip 7-1 and 7-2. On the side of the pin shaft 3 are a series of adjustment holes 8-1, 8-2, and 8-3, which completely pierce through the pin shaft 3, and at the opposite end from the handle 2 is pin shaft end 4 consisting of an abrupt raised edge 4-1 in an exemplary spring loaded weight stack selector pin embodiment of the present invention. Continuing in FIG. 2 is a side elevated view of a spring loaded weight stack selector pin 1 depicted in the compressed position with a handle 2 connected to the top of the pin shaft 3, which is inserted through spring 5-2 shown in the compressed state, and then through a moveable compression base 6 which has a handle grip 7-1 and 7-2. On the side of the pin shaft 3 are a series of adjustment holes 8-1, 8-2, and 8-3, which completely pierce through the pin shaft 3, and at the opposite end from the handle 2 on pin shaft 3 is an pin shaft end 4 consisting of an abrupt raised edge 4-1. Safety pin shaft 12, which is part of safety pin 9, also consisting of an lanyard hole 10, bend 10-1, and holding arm 11, is inserted through adjustment hole 8-1 engaging it to weight stack selector pin 1 in an exemplary spring loaded weight stack selector pin embodiment of the present invention.

Figure 3:
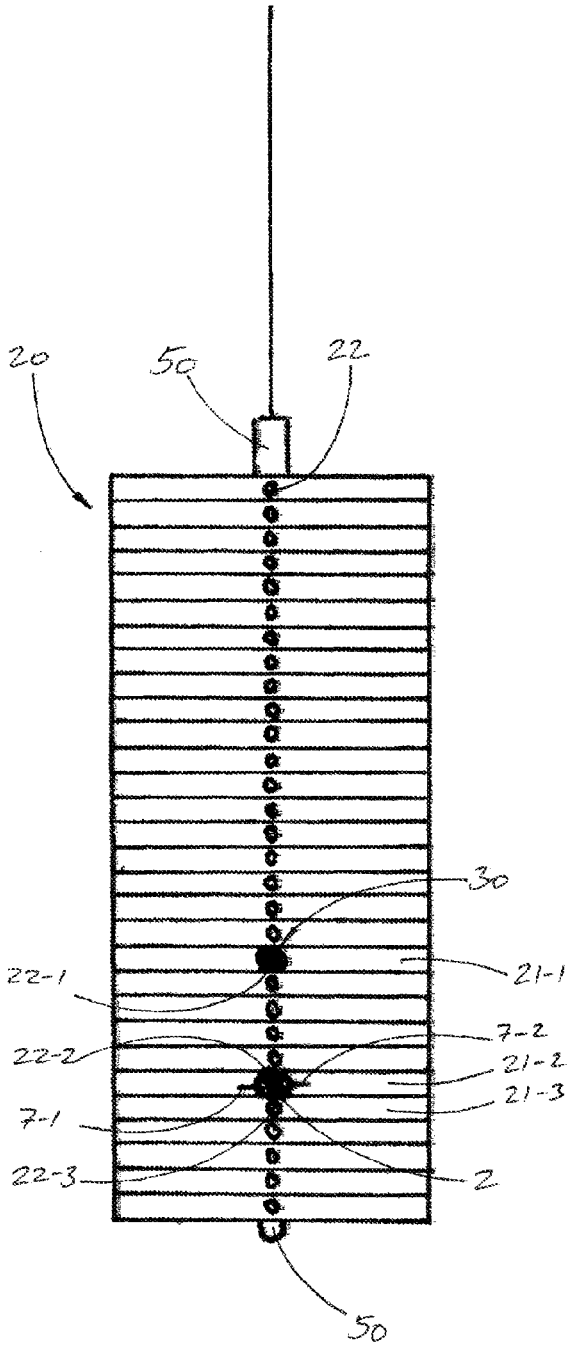
FIG. 3 is a front view of an exemplary weight stack depicted in the stand-by position for a weight training machine with one exemplary spring loaded weight stack selector pin inserted at the heavier weight plate level with a generic standard weight stack selector pin inserted above it at a lighter weight plate level according to an embodiment of the present invention.
Figure 4:
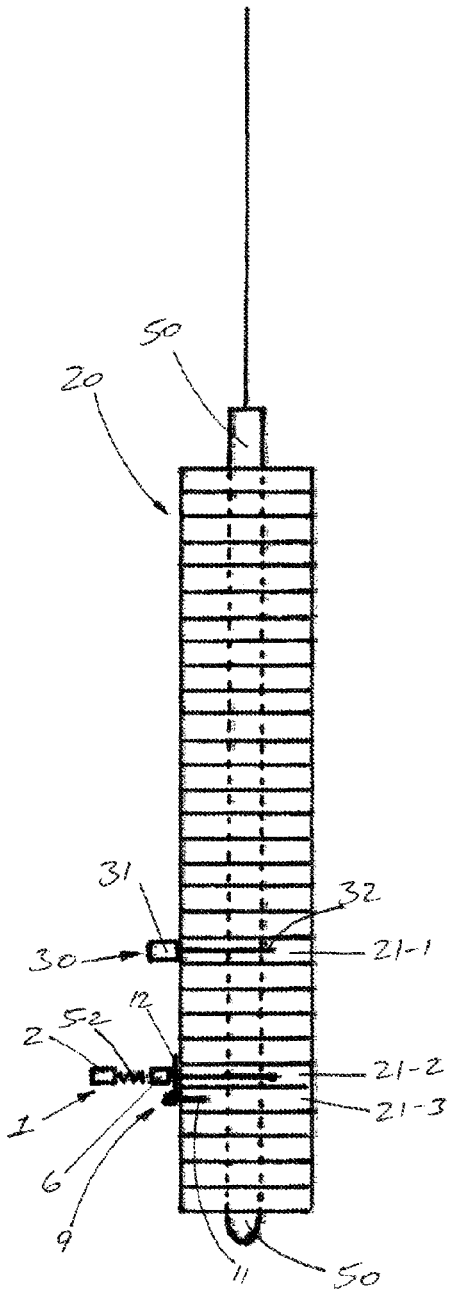
FIG. 4 is a side, cut-away view of an exemplary weight stack depicted in the stand-by position for a weight training machine with one exemplary spring loaded weight stack selector pin inserted at the heavier weight plate level (lowest pin) with an exemplary removable safety pin inserted in the next plate below, and one exemplary generic standard weight stack selector pin inserted at a lighter weight plate level according to an embodiment of the present invention.

For example, while holding the spring loaded weight stack selector pin 1 in one hand, pull back on the compression base handle grip 7-1 and 7-2 with your fore and middle fingers for instance, causing compression base 6 to slide back on pin shaft 3 towards the handle 2, thus compressing the spring 5-2, and hold. Next, with your other hand, insert the safety pin shaft 12 through the appropriate distance adjustment hole 8-1, 8-2, or 8-3 located on the pin shaft 3. In FIG. 2 adjustment hole 8-1 is used. Now, the spring loaded weight stack selector pin 1 is ready for deployment and use on a weight stack such as exemplary weight stack 20, as depicted in FIG. 3 and FIG. 4. Simply select the amount of weight you want to lift first, then line-up the spring loaded weight stack selector pin shaft end 4 with the desired weight plate selector pin hole and insert as far as it will go. The safety pin holding arm 11 should simultaneously insert into the weight plate selector pin hole for the weight plate immediately below. If you are lifting the heaviest weight (the bottom plate of the weight stack), there is no place to insert the safety pin holding arm 11. In this case, use the safety pin lanyard hole 10 to attach a lanyard (not shown), or always keep a lanyard attached, and attach the opposite end of the lanyard to the base or lower frame area of the weight training machine, out of the way of any moving parts, to act as an anchor. A carabiner added to the anchored end of the lanyard is also handy.

FIG. 3 and FIG. 4 depict the start position, demonstrating how you would set-up a weight stack for reduced weight lifting sequences, or drop sets, lifting from heavier to successively lighter weight using the exemplary spring loaded weight stack selector pin 1 as depicted in FIG. 2. FIG. 3 illustrates a front view of an exemplary weight stack 20 depicted in the stand-by position with the center bar 50 not active, for a weight training machine (not shown) with one spring loaded weight stack selector pin 1 showing only a handle 2 connected to the top of the pin shaft 3 (not visible), which is inserted through exemplary spring 5-2 (not visible) in the compressed state, and then through an exemplary moveable compression base 6 which has a handle grip 7-1 and 7-2 which is visible from this view. The pin shaft 3 with a pin shaft end 4 is inserted into the weight stack selector pin hole 22-2 (not visible) at the heavier weight plate 21-2 level. An exemplary safety pin 9 with a bend 10-1 and lanyard hole 10 visible outside of the weight plate 21-3 immediately below weight plate 21-2, and a safety pin holding arm 11 inserted into the weight plate selector pin hole 22-3 located in weight plate 21-3 immediately below weight plate 21-2. A generic standard weight stack selector pin 30 is shown inserted higher up in weight stack 20 engaged in a lighter weight plate 21-1 level showing only the pin handle 31 protruding from weight plate selector pin hole 22-1 (not visible from this view) in weight plate 21-1 in an exemplary spring loaded weight stack selector pin embodiment of the present invention. FIG. 4 depicts the same set-up as FIG. 3, but as a side cut-away view showing exemplary weight stack 20 for a weight training machine (not shown) depicted in the stand-by position with one spring loaded weight stack selector pin 1 inserted at the heavier weight plate 21-2 level depicting a handle 2 connected to the top of the exemplary pin shaft 3, which is inserted through spring 5-2 in the compressed state; and then through a moveable compression base 6, which has a handle 7-2 and 7-1 (not shown), and a safety pin 9 which has a lanyard hole 10 and safety pin bend 10-1, with safety pin shaft 12 inserted through adjustment hole 8-1, and exemplary holding arm 11 inserted into selector pin hole 22-3 located in the weight plate 21-3 immediately below weight plate 21-2; and one generic standard weight stack selector pin 30 inserted into weight plate selector pin hole 22-1 at a lighter weight plate 21-1 level, showing a pin handle 31 and pin shaft 32 in an exemplary spring loaded weight stack selector pin embodiment of the present invention.

Figure 5:
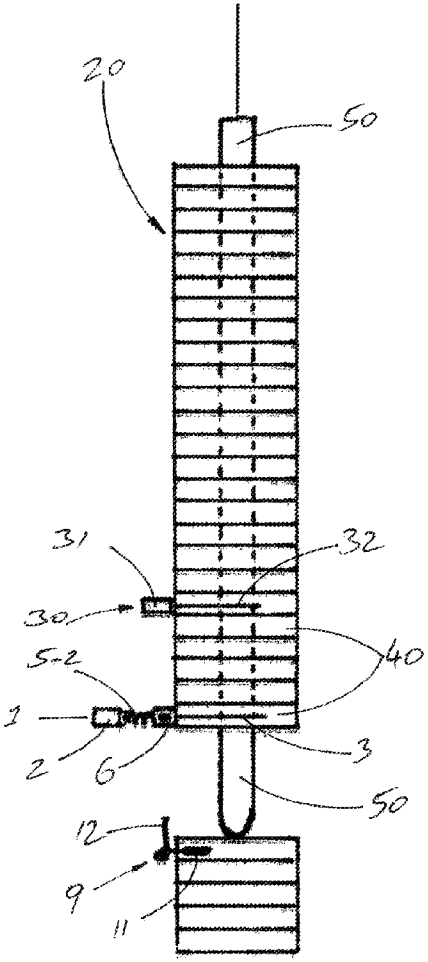
FIG. 5 is a side, cut-away view of an exemplary weight stack depicted in the active (lifted) position for a weight training machine (not shown) with one exemplary spring loaded weight stack selector pin inserted at the heavier weight level (lowest pin) and an exemplary removable safety pin, which has disengage from the spring loaded weight stack selector pin as a result of the weight stack plates being lifted by the user of the weight machine, with exemplary holding arm still inserted in the lower weight plate, and one exemplary generic standard weight stack selector pin inserted at a lighter weight level according to an embodiment of the present invention.

FIG. 5 depicts the positioning and actions of spring loaded weight stack selector pin 1 and safety pin 9 when the weight is initially lifted while performing the reps, and when the weight is set down again. FIG. 5 is a side cut-away view of an exemplary weight stack 20 for a weight training machine (not shown) depicted in the active (lifted) position having the center bar 50 active, with one spring loaded weight stack selector pin 1 inserted at the heavier weight plate 21-2 level in selector pin hole 22-2, depicting an exemplary handle 2 connected to the top of the pin shaft 3, which is inserted through spring 5-2 in the compressed state; and then through a moveable compression base 6, which has a handle 7-2 and 7-1 (not shown), and a safety pin 9 which has disengage (released) from the spring loaded weight stack selector pin 1 as a result of the weight stack plates being lifted by the user of the weight machine (not shown). The safety pin 9 has an exemplary lanyard hole 10 and holding arm 11, which is shown still inserted in the weight stack selector pin hole 22-3 in weight plate 21-3, but may also fall-out onto the floor after it separates from spring loaded weight stack selector pin 1 without causing any adverse effect. The weight of the weight stack plates 40, starting with the selected weight plate where the spring loaded weight stack selector pin 1 is engaged and up to the weight plate immediately below the next preset weight as shown, creates enough friction to hold the spring loaded weight stack selector pin 1 against the force of the spring 5-2 in the compressed state while the reps are performed. Also depicted in FIG. 5 is one generic standard weight stack selector pin 30 in stand-by mode, inserted at a lighter weight plate 21-1 level in selector pin hole 22-1, with pin handle 31 and pin shaft 32 in an exemplary spring loaded weight stack selector pin embodiment of the present invention.

Figure 6:
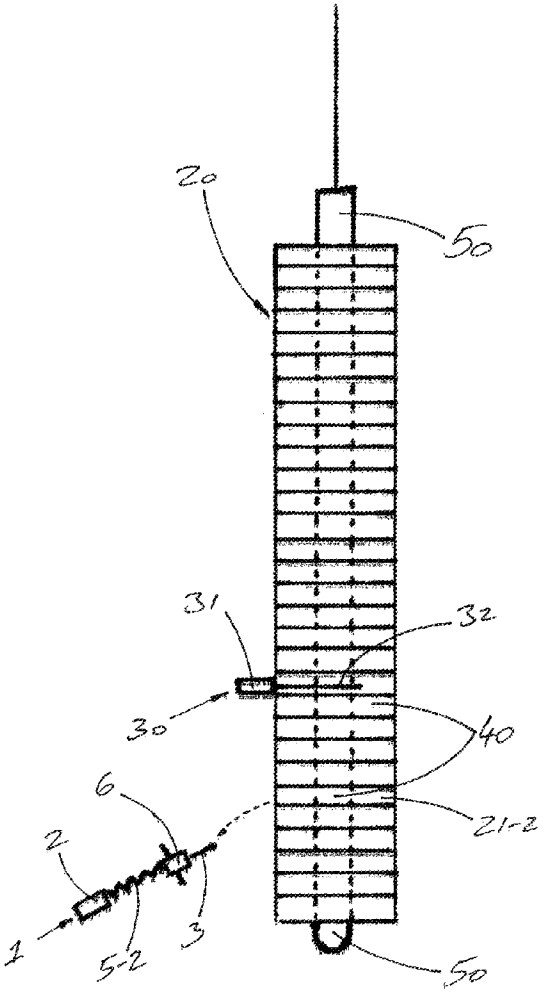
FIG. 6 is a side, cut-away view of an exemplary weight stack depicted in the stand-by position for a weight training machine after the user has completed the first set of lifting repetitions (reps) with one exemplary spring loaded weight stack selector pin shown in the action of popping-out with an exemplary removable safety pin which has disengaged from the spring loaded weight stack pin, as a result of the weight stack plates being lifted by the user of the weight machine, and exemplary holding arm still inserted in the lower weight plate, and one exemplary generic standard weight stack selector pin still inserted above at a lighter weight level according to an embodiment of the present invention.

Continuing with FIG. 6, the weight stack 20 is shown set down (not lifted) with the center bar 50 not active. The spring loaded weight stack selector pin 1 is no longer held by the friction created by the weight of the weight stack plates 40, and thus the spring loaded weight stack selector pin 1 pops out due to the force of the compressed spring 5-2 (not shown), which causes the spring to return to the released state 5-1. FIG. 6 is a side cut-away view of an exemplary weight stack 20 for a weight training machine depicted in the stand-by position after the user completed the first set of lifting repetitions with one spring loaded weight stack selector pin 1 shown popping-out of the selector pin hole 22-2 located in weight plate 21-2, and depicting a handle 2 connected to the top of the pin shaft 3, which is inserted through spring 5-1 in the released state; and then through an moveable compression base 6, which has an exemplary handle 7-2 and 7-1 (not shown), and an exemplary safety pin 9 which has disengage from the spring loaded weight stack selector pin 1, as a result of the weight stack plates being lifted by the user of the weight machine (not shown), and one exemplary generic standard weight stack selector pin 30 still inserted above at a lighter weight plate 21-1 level showing a pin handle 31 and pin shaft 32 in an exemplary spring loaded weight stack selector pin embodiment of the present invention.

Figure 7:
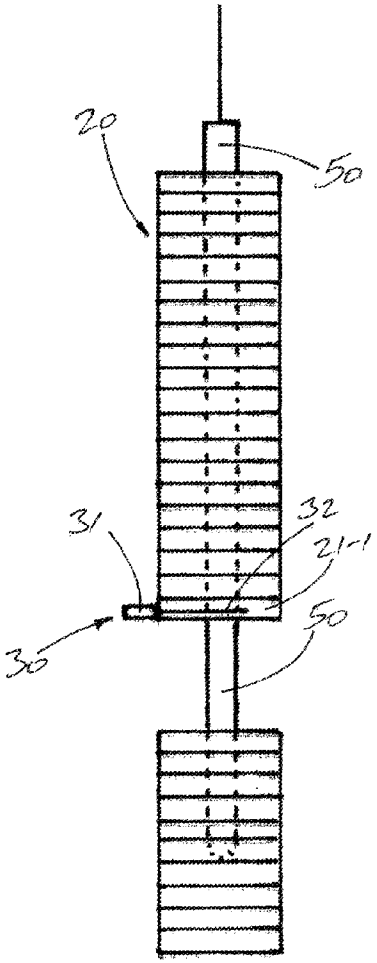
FIG. 7 is a side, cut-away view of an exemplary weight stack for a weight training machine (not shown) depicted in the active (lifted) position with one exemplary generic standard weight stack selector pin inserted in a selector pin hole at a lighter weight plate level according to an embodiment of the present invention.

Now, only the generic standard weight stack selector pin 30 remains and the last part of the intense set can be executed as shown in FIG. 7. In a side cut-away view, FIG. 7 depicts an exemplary weight stack 20 for a weight training machine (not shown), shown in the active (lifted) position having the center bar 50 active, with one generic standard weight stack selector pin 30 still inserted in weight plate selector pin hole 22-1 at a lighter weight plate 21-1 level in an exemplary spring loaded weight stack selector pin embodiment of the present invention. A second spring loaded weight stack selector pin 1 with a safety pin 9 can be used instead of the exemplary generic standard weight stack selector pin 30 that is usually attached to the weight machine. One, two, or more spring loaded weight stack pins may be used to set-up a weight stack for a reduced weight lifting sequence.

The embodiments disclosed herein are to be considered in all respects as illustrative, and not restrictive of the invention. The present invention is in no way limited to the embodiments described above. Various modifications and changes may be made to the embodiments without departing from the spirit and scope of the invention. The scope of the invention is indicated by the attached claims, rather than the embodiments. Various modifications and changes that come within the meaning and range of equivalency of the claims are intended to be within the scope of the invention.

What is claimed is:

1. A spring loaded weight stack selector pin device used to preset one or more weight amounts to be lifted in decreasing succession of heaviest to lightest weight on a weight training machine having a weight stack consisting of a plurality of weight plates, the spring loaded weight stack selector device comprising:

a pin having a shaft with a shaft end configured to be inserted into a weight plate selector hole;

a pin shaft end having an abrupt raised edge;

a handle attached to the pin shaft;

a spring loaded apparatus movably mounted to the pin;

an adjustment mechanism configured to reveal more or less of the pin shaft allowing the pin to fit into weight plate selector pin holes of varying lengths;

a safety pin consisting of a shaft configured to be removeably engaged in the adjustment mechanism, and having a holding arm connected to the safety pin shaft configured to be inserted into a weight plate selector pin hole of the weight plate positioned directly underneath the weight plate to be lifted; and a lanyard to attach to the safety pin using the lanyard hole incorporated in the safety pin shaft, and using said lanyard as an anchor for the safety pin in the case where the entire weight stack is to be used in the weight lift, resulting in no weight plates remaining underneath the lifted grouping of plates.

2. The spring loaded weight stack selector device as recited in claim 1, wherein the exposed pin shaft may be adjusted relative to the amount of compression of the spring, allowing the weight stack selector pin to be compatible with weight stack plates of differing dimensions and weight plate selector pin hole lengths.

3. The spring loaded weight stack selector device as recited in claim 1, wherein lifting the selected weight plates causes the weight stack selector pin to move in an upward vertical direction with the weight plate away from the second pin shaft that is engaged in the adjustment mechanism, while the second pin holding arm remains inserted in the weight plate selector pin hole of the next heavier plate that is not being lifted, causing the safety pin to be held in a stationary position.

4. The spring loaded weight stack selector device as recited in claim 1, wherein the weight of the lifted weight plate that the pin is inserted and all the plates above it up until the last plate preceding the next weight plate with a selector pin inserted in the weight plate selector pin hole, produce friction when they are lifted, allowing the weight stack selector pin to remain in an engaged position in the weight stack plate selector hole until the weight is no longer being lifted and is set down.

5. The spring loaded weight stack selector device as recited in claim 1, wherein at the point the selected weight is no longer being lifted, no friction is produced, and the spring loaded apparatus automatically uncompresses forcing the pin to immediately release from the weight plate selector pin hole, allowing uninterrupted advancement to the next lower preselected weight to be lifted.

6. The spring loaded weight stack selector device as recited in claim 1, wherein one weight stack selector device is used to preselect the heaviest and first weight to be lifted in the reduced weight lifting sequence, with a second lighter weight preselected using a standard weight stack plate selector pin that does not automatically release.

7. The spring loaded weight stack selector device as recited in claim 1, wherein two or more spring loaded weight stack selector devices are employed to preselect three or more weight amounts to be lifted in a reduced weight lifting sequence, with the final lightest weight preselected using a standard selector pin that does not automatically release.

8. The spring loaded weight stack selector device as recited in claim 1, wherein one or more spring loaded weight stack selector devices are employed to preselect one or more weight amounts to be lifted in a reduced weight lifting sequence.

9. The spring loaded weight stack selector device as recited in claim 1, wherein a lanyard is attached at one end to the second pin and the opposite end of the lanyard is anchored to the base or lower frame area of the weight training machine, away from any moving parts, allowing the entire weight stack to be lifted, the heaviest weight possible, at the start of a reduced weight lifting sequence.

10. The spring loaded weight stack selector device as recited in claim 1, wherein the entire device is portable.

* * * * *